US006050458A

United States Patent [19]

Lee

[11] Patent Number: 6,050,458

[45] Date of Patent: Apr. 18, 2000

[54] BOTTLE CAP DEPRESSABLE TO EJECT CONTENTS OF THE BOTTLE

[75] Inventor: Yu-Kang Lee, Taipei, Taiwan

[73] Assignee: Jung Kuo Enterprise Co., Ltd., Taipei, Taiwan

[21] Appl. No.: 09/371,849

[22] Filed: Aug. 11, 1999

[51] Int. Cl.[7] ..... B65D 88/54

[52] U.S. Cl. ..... 222/321.9

[58] Field of Search ..... 222/321.9, 383.1, 222/382

[56] References Cited

U.S. PATENT DOCUMENTS

| | | | |
|---|---|---|---|
| 5,725,128 | 3/1998 | Foster | 222/321.9 |
| 5,738,250 | 4/1998 | Gillingham et al. | 222/321.9 |
| 5,826,756 | 10/1998 | Foster | 222/321.9 |

*Primary Examiner*—Philippe Derakshani
*Attorney, Agent, or Firm*—Rosenberg, Klein & Lee

[57] ABSTRACT

A bottle cap depressable to eject contents of the bottle has a depressing outlet member, a connecting member and a securing member. The securing member has an upper and a lower securing end portions each having several securing teeth. The upper end securing teeth have upwards-aimed sloped surfaces while the lower end securing teeth have downwards-aimed sloped surfaces. The upper and the lower securing end portions are inserted into the depressing outlet member, and a straw combination respectively with the securing teeth of the upper and the lower end portion securely engaging the inner circumference of the depressing outlet member and that of the straw combination respectively. Thus, the depressing outlet member is securely connected to the straw combination, preventing the bottle from separating from the outlet member and falling down to the ground when a user lifts the bottle from the outlet member.

1 Claim, 3 Drawing Sheets

BOTTLE CAP DEPRESSABLE TO EJECT CONTENTS OF THE BOTTLE

BACKGROUND OF THE INVENTION

Bottles with a cap depressable to eject contents are used for holding liquid detergents, shampoo, hair spray, etc.

Referring to FIG. 4, a heretofore known bottle cap depressable to eject contents comprises a depressing outlet part 30, a straw combination 20 and a connecting member 10. The connecting member 10 is screwed onto a connecting neck of a bottle (not shown).

The straw combination 20 has a straw 201 and a connecting tube part 202, and is passed through, and connected to the connecting member 10 with the straw 201, and the connecting tube part 202 located on the lower side and the upper side of the connecting member 10 respectively. The straw combination 20 has springs and other related components therein; they are not shown in the drawings and will not be detailed here because they are not the subjects of the present invention.

The depressing outlet part 30 is fitted on the connecting tube part 202 such that liquid contained inside the bottle can be ejected through the straw combination 20 and the depressing outlet part 30 for use.

However, it is found that the bottle cap depressable to eject contents of the bottle has an undesirable feature: the depressing outlet part 30 is only mounted on the connecting tube part 202 so the bottle having liquid contained therein is relatively heavy, and likely to fall down to the ground and get damaged when a user lift it from the depressing outlet part 30, making the connecting tube part 202 separated from the depressing outlet part 30.

SUMMARY OF THE INVENTION

Therefore, it is a main object of the present invention to provide a bottle cap depressable to eject contents of the bottle which has a depressing outlet part securely connected to a straw combination such that the depressing outlet part cannot be separated from the straw combination when lifted therefrom, preventing the bottle having liquid contained therein from falling down to the ground and getting damaged.

The bottle cap depressable to eject contents of the bottle of the present invention comprises:

- a connecting member screwed onto a neck portion of the bottle;
- a depressing outlet member having an inner tube part movably passed into the connecting member, the depressing outlet member having an outlet portion connected to the inner tube part, the outlet portion is depressable for ejecting the contents through same and the inner tube part;
- a securing member having a through passage, and an upper and a lower securing end portions each having several securing teeth; the securing teeth of the upper and the lower securing end portions having upwards-aimed and dowards-aimed sloped surfaces respectively; the upper securing end portion being inserted into a lower end portion of the inner tube part of the depressing outlet member with the securing teeth thereof securely engaging an inner circumference of the inner tube part; the lower securing end portion being inserted into an upper end portion of a straw combination received in the bottle with the securing teeth securely engaging an inner circumfence of the straw combination.

The contents can be ejected from the bottle through the straw combination, the through passage of the securing member, and the depressing outlet member in sequence.

The securing teeth with the above said sloped surfaces can prevent same from falling off the inner tube part and the straw combination. Therefore, the bottle cannot separate from the depressing outlet member and fall down to the ground when a user lifts the bottle from the depressing outlet part.

BRIEF DESCRIPTION OF THE DRAWINGS

The present invention will be better understood by reference to the accompanying drawings, wherein.

DETAILED DESCRIPTION OF THE PREFERRED EMBODIMENT

Figure 1:
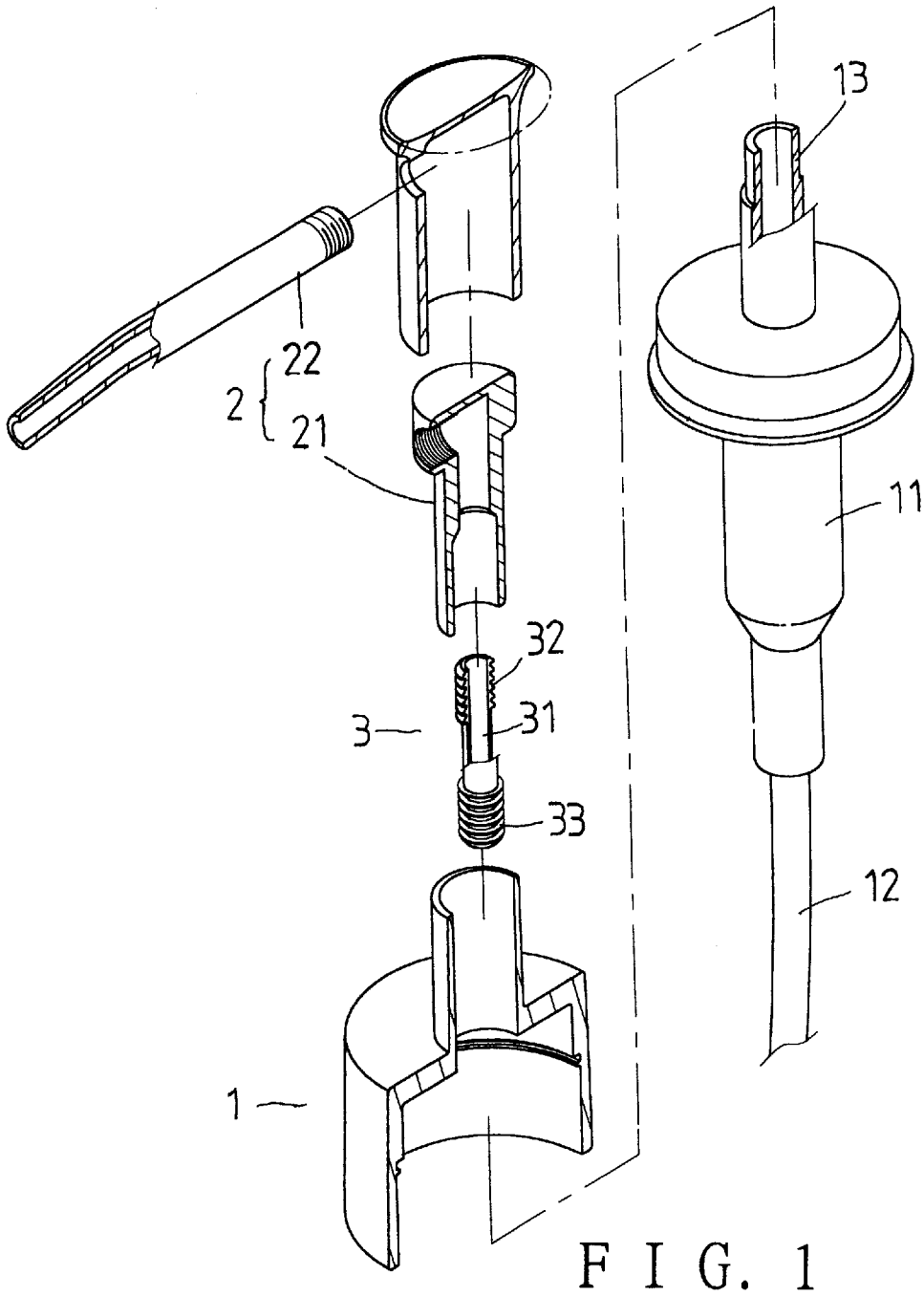
FIG. 1 is an exploded perspective view of a bottle cap depressable to eject contents of the bottle of the present invention.
Figure 2:
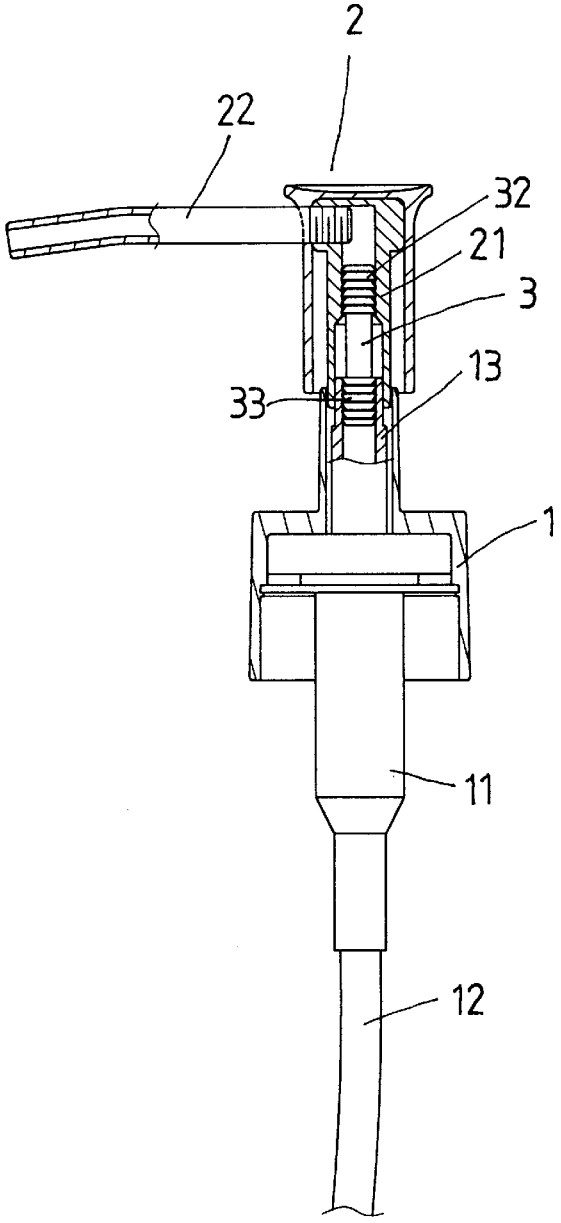
FIG. 2 is a cross-sectional view of the bottle cap depressable to eject contents of the bottle in FIG. 1.

Referring to FIGS. 1 and 2, a bottle cap depressable to eject contents of the bottle of the present invention comprises a connecting member 1, a depressing outlet member 2 and a securing member 3 as the main parts.

The connecting member 1 is screwed onto a neck portion (not shown) of the bottle.

A straw combination 11 is passed through and connected to, the connecting member 1. The straw combination 11 has a straw part 12 and a connecting tube part 13 in open communication with each other. The connecting tube part 13 and the straw part 12 are located at an upper side and a lower side of the connecting member 1 respectively.

The depressing outlet member 2 has an inner tube 21 connected to an outlet 22. The inner tube 21 is in open communication with the outlet 22.

Figure 3:
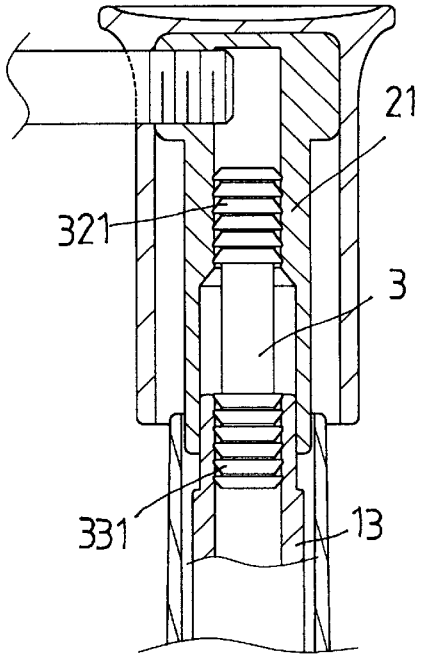
FIG. 3 is a fragmentary cross-sectional view of the bottle cap depressable to eject contents of the bottle in FIG. 1.
Figure 4:
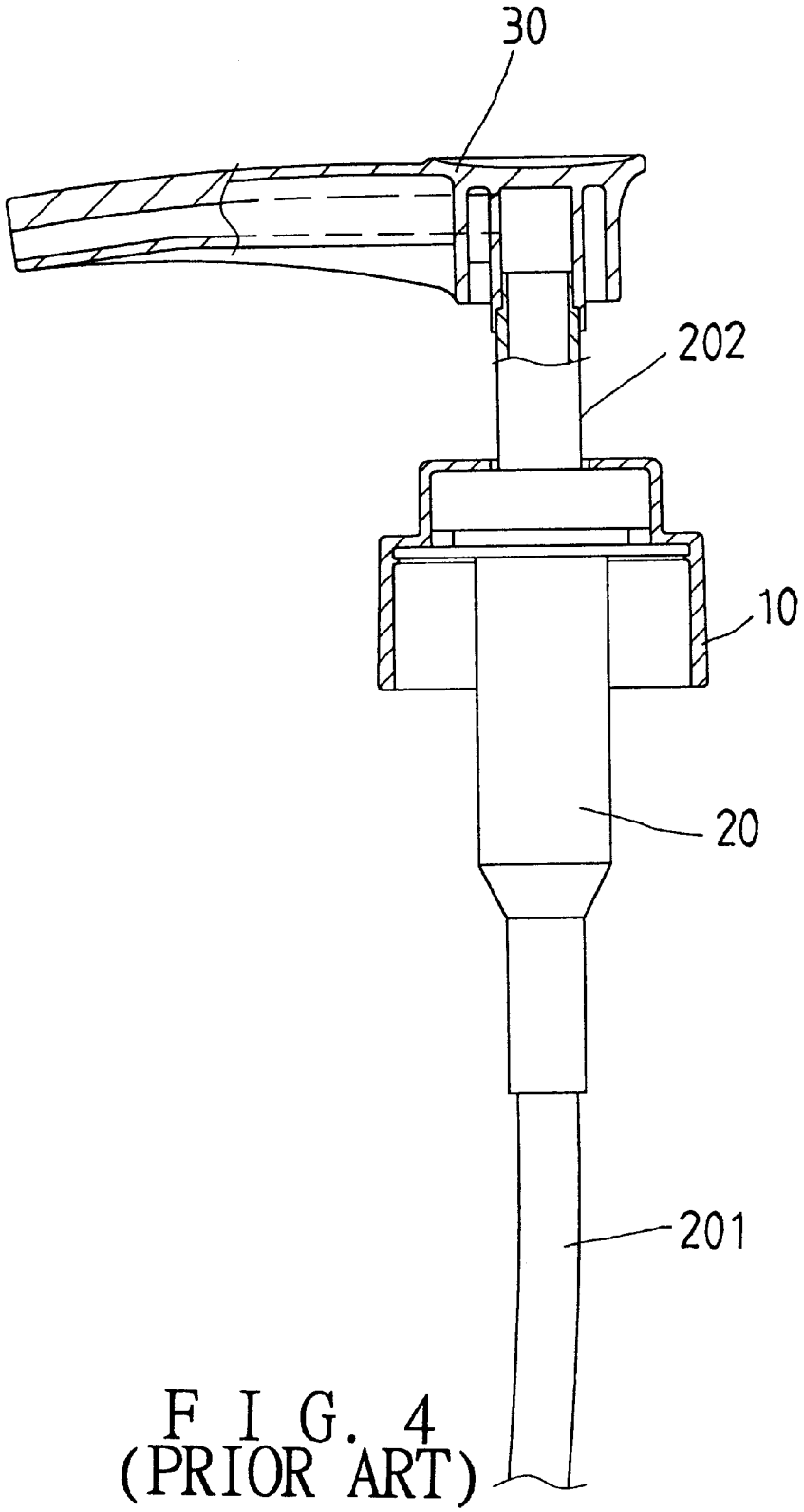
F I G. 4 (PRIOR ART)
FIG. 4 is a cross-sectional view of the prior art bottle cap depressable to eject contents of the bottle as described in the Background.

The securing member 3 has a through passage 31, and an upper and a lower securing end portions 32, 33; the securing end portions 32, 33 each has several securing teeth 321, 331 (see FIG. 3). The securing teeth 321 of the upper securing end portion 32 have sloped surfaces aimed upwards while the securing teeth 331 of the lower securing end portion 33 have sloped surfaces aimed downwards.

The upper securing end portion 32 is inserted into the inner tube 21 of the depressing outlet member 2 from a lower side; the upper securing end portion 32 can be easily inserted into the inner tube 21 because the sloped surfaces of the securing teeth 321 are aimed upwards. Similarly, the lower securing end portion 33 is inserted into the connecting tube part 13 from an upper side, and can be inserted easily because the sloped surfaces of the securing teeth 331 are aimed downwards.

Thus, the securing member 3 can be securely connected to both the inner tube 21 and the connecting tube part 13, and cannot be easily separated from same because of the securing teeth 321, 331 engaging inner circumferences of both the inner tube 21 and the connecting tube part 13.

In using the bottle, a user depresses the depressing outlet member 2 to eject the contens from the bottle through the straw combination 11, the through passage 31 of the securing member 3, and the depressing outlet member 2 in sequence.

Because the depressing outlet member 2 is securely connected to the straw combination 11 by means of the securing member 3, same cannot be easily separated from the bottle in case a user lifts the bottle from the depressing outlet member 2, preventing the bottle from unwarily falling down to the ground and getting damaged.

Therefore, the bottle cap depressable to eject contents of the bottle of the present invention has an advantage over the prior art one. The bottle is securely connected to the depressing outlet member, and cannot unwarily fall down to the ground when a user lifts it from the depressing outlet member.

What is claimed is:

1. A bottle cap depressable to eject contents of a bottle, comprising:

(a) a connecting member screwed onto a neck portion of said bottle;

(b) a depressing outlet member having an inner tube part movably passed into said connecting member, said depressing outlet member having an outlet connected to, and in open communication with, said inner tube part for permitting contents of said bottle to be ejected therethrogh;

(c) a securing member having a through passage, and an upper and a lower securing end portions each having a plurality of securing teeth, said securing teeth of said upper and said lower securing end portions having sloped surfaces aimed upwards and downwards respectively, said upper securing end portion being inserted into said inner tube part of said depressing out let member from an lower side of said inner tube part, said securing teeth of said upper securing end portion engaging an inner circumference of said inner tube part for preveinting said securing member from separating from said inner tube part; said lower securing end portion of said securing member being inserted into a straw combination connected to said connecting member from an upper side of said straw combination, said straw combination being in open communication with said through passage and having a straw received in said bottle for permitting said contents of said bottle to be ejected therethrough said securing teeth engaging an inner circumference of said straw combination for preventing said securing member from separating from said straw combination.

* * * * *